US006883552B2

(12) United States Patent
Ooyauchi et al.

(10) Patent No.: US 6,883,552 B2
(45) Date of Patent: Apr. 26, 2005

(54) METAL TUBE AND ITS PRODUCTION METHOD

(75) Inventors: Tetsuya Ooyauchi, Kanagawa (JP); Masayuki Okano, Tokyo (JP)

(73) Assignees: Terumo Kabushiki Kaisha, Tokyo (JP); Okano Kogyo Co., Ltd., Tokyo (JP)

( * ) Notice: Subject to any disclaimer, the term of this patent is extended or adjusted under 35 U.S.C. 154(b) by 4 days.

(21) Appl. No.: 10/329,478

(22) Filed: Dec. 27, 2002

(65) Prior Publication Data

US 2003/0127149 A1 Jul. 10, 2003

(30) Foreign Application Priority Data

Dec. 27, 2001 (JP) ..... 2001-396766

(51) Int. Cl.[7] ..... F16L 9/00; B21D 51/10

(52) U.S. Cl. ..... 138/177; 138/DIG. 11; 72/370.14; 72/370.15; 428/586; 428/600; 205/73

(58) Field of Search ..... 138/177, 178, 138/DIG. 11, 143; 205/640, 131, 73; 204/272; 72/370.14, 370.15; 428/577, 586, 600

(56) References Cited

U.S. PATENT DOCUMENTS

| | | | | | |
|---|---|---|---|---|---|
| 2,855,929 | A | * | 10/1958 | Hein, Jr. | 604/411 |
| 3,173,200 | A | * | 3/1965 | Dunmire et al. | 29/414 |
| 3,289,675 | A | * | 12/1966 | Eby et al. | 604/272 |
| 4,672,734 | A | * | 6/1987 | Kawada et al. | 29/517 |
| 4,785,868 | A | | 11/1988 | Koenig, Jr. | |
| 5,074,555 | A | * | 12/1991 | Meredith | 473/323 |
| 5,294,309 | A | * | 3/1994 | Seimiya et al. | 205/660 |
| 5,640,874 | A | | 6/1997 | Vecsey | |
| 5,842,086 | A | * | 11/1998 | Honma et al. | 399/159 |
| 5,951,528 | A | * | 9/1999 | Parkin | 604/239 |
| 5,968,076 | A | | 10/1999 | Granger et al. | |
| 6,337,459 | B1 | * | 1/2002 | Terwijn et al. | 219/121.47 |
| 6,579,628 | B1 | * | 6/2003 | Takeuchi et al. | 428/667 |

FOREIGN PATENT DOCUMENTS

| | | | | | |
|---|---|---|---|---|---|
| EP | 0 180 125 | A2 | | 5/1986 | |
| EP | 0 452 501 | A1 | | 10/1991 | |
| EP | 1361018 | A1 | * | 11/2003 | B23P/15/00 |
| JP | 02065870 | A | * | 3/1990 | A61M/5/158 |
| JP | 03284264 | A | * | 12/1991 | A61M/5/32 |
| WO | WO 98/37853 | A1 | | 9/1998 | |

* cited by examiner

*Primary Examiner*—Patrick Brinson
(74) *Attorney, Agent, or Firm*—Burns, Doane, Swecker & Mathis, L.L.P.

(57) ABSTRACT

A small diameter metal tube having at least two inner diameters is provided. A method for producing this metal tube is also provided. In this method, a plate member having a development shape of the metal tube is blanked from a metal thin plate so that the plate member is left partly tied to the metal thin plate, the plate member is press formed into a tubular body having the at least two inner diameters, and the plate member partly tied to the metal thin plate is cut apart to produce the metal tube having at least two inner diameters.

5 Claims, 8 Drawing Sheets

METAL TUBE AND ITS PRODUCTION METHOD

BACKGROUND OF THE INVENTION

1. Field of the Invention

This invention relates to a metal tube of irregular shape which has at least two inner diameters, and its production method. To be more specific, this invention relates to a small diameter, irregular shaped metal tube which can be used for a pin, injection needle, connector, electron gun for TV liquid crystal, and the like, and its production method.

2. Prior Art

Metal tubes of small diameter such as those having, for example, an outer diameter of up to 2 mm and used for a medical pin, injection needle, connector, electron gun for TV, or the like are typically produced by curling a metal thin plate having a thickness of up to 0.2 mm simultaneously with the drawing, welding the abutting edges of the thin plate just before its entrance into a drawing die, drawing the welded member through the drawing die to form a tube having an outer diameter of about 4 to 6 mm, and repeating the drawing process to thereby produce a final tube product having a tapered or stepped side profile with at least two inner diameters. FIG. 12 shows typical process of drawing. In FIG. 12, a metal tube 1 which has been formed to an outer diameter of about 4 to 6 mm is drawn through a die 2 having a die bore of smaller cross section to thereby reduce the outer diameter and produce a tube having a cross section identical with the bore of the die. In the drawing, a plug 3 is inserted in the tube 1 to thereby prevent the occurrence of creases on the inner surface of the tube 1 during the drawing process.

However, when the diameter of the tube 1 becomes reduced after repeated drawings, insertion of the plug 3 in the tube 1 becomes impossible, and such drawing with no plug 3 is inevitable. When the tube 1 is drawn with no plug 3 inserted in the tube 1, the inner surface of the tube 1 becomes creased and the inner surface will suffer from an increased surface roughness which results in the increase in the resistance of a fluid passing through the tube 1. Increase in the surface roughness also results in the increase in the surface area which invites adhesion of dirt and foreign matters. This is a serious problem when the tube is used for a medical application where hygiene is of serious interest. In spite of such situation, there has so far been no small diameter tube which is free from the problem of the rough inner surface.

As described above, there is a strong demand for a small diameter metal tube with a smooth inner surface having at least two inner diameters and which can be used for an injection needle, as well as its production method.

SUMMARY OF THE INVENTION

An object of the present invention is to obviate the problems of the prior art technology as described above by providing a small diameter metal tube which has at least two inner diameters.

Another object of the invention is to provide its production method.

In order to attain the object as described above, the present invention provides a metal tube which has at least two inner diameters, wherein the inner surface of the tube has a maximum height difference (Rf) in the surface roughness of up to 3 $\mu$m, and the tube has a minimum inner diameter of up to 2 mm and a maximum inner diameter of up to 5 mm.

Also provided by the present invention is a method for producing a metal tube having at least two inner diameters, comprising the steps of:

blanking a plate member having a development shape of the metal tube from a metal thin plate such that the plate member is left partly tied to the metal thin plate;

press forming the plate member into a tubular body having the at least two inner diameters; and cutting apart the plate member partly tied to the metal thin plate to produce the metal tube having the at least two inner diameters.

In the metal tube producing method of the present invention, the plate member, after having been press formed into a tubular body having the at least two inner diameters, is preferably welded at a seam thereon to produce the metal tube having the at least two inner diameters.

In the metal tube producing method of the present invention, in the step of press forming, a part in the plate member corresponding to the distal or proximal end of the tube obtained by the press forming is preferably moved either upward or downward from the plane of the metal thin plate so that the central axis of the tube during the press forming will be parallel to the plane of the metal thin plate.

This invention also provides a metal tube produced by the method of the present invention.

BRIEF DESCRIPTION OF THE DRAWINGS

FIG. 3B being a view when the plate member has been curled by press forming.

FIG. 4D showing the plate member which has been press formed into a tube.

FIG. 6B being a cross section taken from the side of the tube having a larger inner diameter.

DETAILED DESCRIPTION OF THE INVENTION

Next, the method for producing the metal tube of the present invention as well as the metal tube produced by such method are described with reference to the preferred embodiments shown in the accompanying drawings.

Figure 1A:
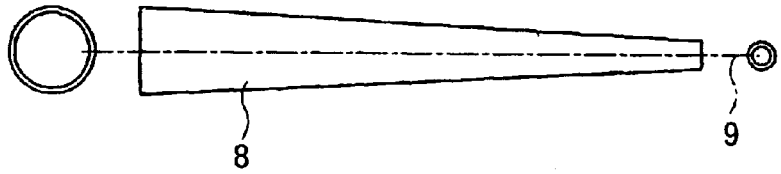
FIGS. 1A, 1B and 1C are front, side and back views of tubes according to some embodiments of the present invention.
Figure 1B:
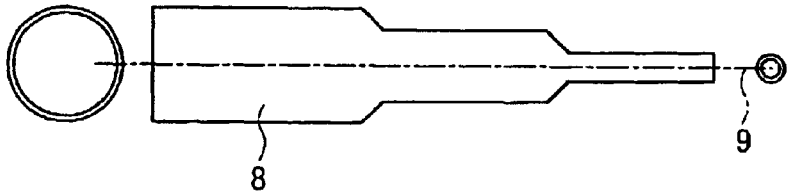
Figure 1C:
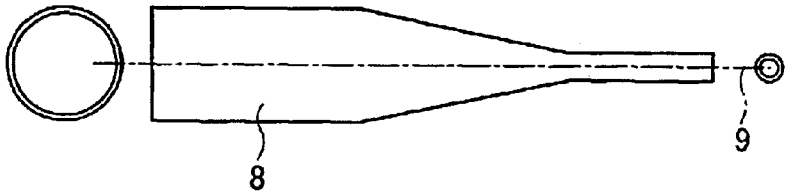
Figure 2A:
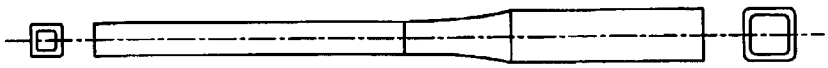
FIGS. 2A to 2E are front, side and back views of tubes according to other embodiments of the present invention.
Figure 2B:
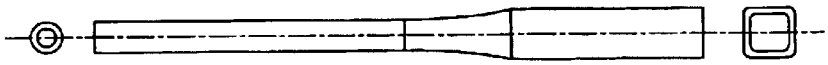
Figure 2C:
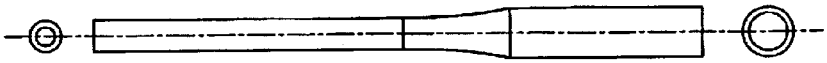
Figure 2D:
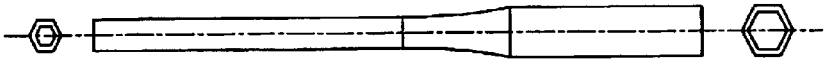
Figure 2E:
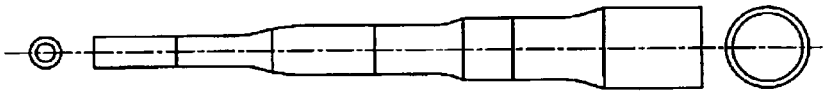

The metal tube of the present invention is characterized by its irregular shape having at least two inner diameters. Typical such tubes include a hollow tube 8 having a circular cross section as shown in FIG. 1A which is tapered from the distal end having a smaller inner diameter to the proximal end having a larger inner diameter; a hollow tube 8 of circular cross section as shown in FIG. 1B having a stepped side profile which comprises a distal portion having a small inner diameter, a proximal portion having a large inner diameter, and an intermediate portion between the distal and proximal portions which is different in the inner diameter from the distal and proximal portions; and a hollow tube 8 of circular cross section as shown in FIG. 1C comprising a distal portion having a small inner diameter, a proximal portion having a large inner diameter, and a transient portion between the distal and proximal portions. In FIGS. 1A to 1C, reference numeral 9 represents the central axis of the tube 8. Further examples of the tube according to the present invention are shown in FIGS. 2A to 2E. FIG. 2A shows a hollow tube of quadrilateral cross section which comprises a distal portion having a small inner diameter, a proximal portion having a large inner diameter, and a transient portion between the distal and proximal portions. FIG. 2B shows a hollow tube which comprises a distal portion having a small inner diameter, a proximal portion having a large inner diameter, and a transient portion between the distal and proximal portions, and in which the distal portion has a circular cross section whereas the proximal portion has a quadrilateral cross section. FIG. 2C shows a hollow tube of circular cross section which comprises a distal portion having a small inner diameter, a proximal portion having a large inner diameter, and a transient portion between the distal and proximal portions. FIG. 2D shows a hollow tube of hexagonal cross section comprising a distal portion having a small inner diameter, a proximal portion having a large inner diameter, and a transient portion between the distal and proximal portions. FIG. 2E shows a hollow tube of circular cross section comprising a distal portion having a small inner diameter, a proximal portion having a large inner diameter, two first and second intermediate portions formed between the distal and proximal portions and having inner diameters which are different from each other and which are also different from those of the distal and proximal portions, and transient portions formed between the distal portion and the first intermediate portion, between the first and second intermediate portions, and between the second intermediate portion and the proximal portion.

Typical application of such metal tube having at least two inner diameters is an injection needle used in epidural injection. In the case of inserting the injection needle for use in epidural injection, the tapered or stepped profile of the needle functions as a sensor or indicator for the location of the needle tip, thereby preventing nerve and other fine tissues from being damaged by the needle which had gone too far.

In the present invention, the tube may also have a cross section other than circle, as exemplified by polygonal such as quadrilateral or hexagon, or ellipsoid as shown in FIGS. 2A to 2E.

In the present invention, the tube typically has an outer diameter of up to 8 mm, and preferably up to 5 mm. When the tube is used for an injection needle, the tube may have an outer diameter of up to 2 mm, preferably up to 1 mm, and more preferably up to 0.4 mm. When the outer diameter is within such range, the tube used as an injection needle will experience reduced resistance in its insertion into the skin, and pain associated with the injection will be reduced.

In the present invention, the tube has at least two inner diameters, and of the at least two inner diameters, the maximum inner diameter is up to 5 mm, preferably up to 1.5 mm, and more preferably up to 0.8 mm.

Of the at least two inner diameters of the tube, the minimum inner diameter is up to 2 mm, preferably up to 1 mm, and more preferably up to 0.5 mm.

When the tube has an inner diameter within such range, the tube will enjoy sufficient strength required for the tube when the tube has an outer diameter within the above-specified range.

In the present invention, the tube inner surface has a maximum height difference (Rf) in the surface roughness as defined by JIS-B-0601-1994 of up to 3 $\mu$m, preferably up to 2 $\mu$m, and more preferably up to 1 $\mu$m. When the tube inner surface has an Rf within the above-specified range, the entire inner surface of the tube will be smooth with no major scratch, and the tube will be quite suitable for use as a medical device.

The metal constituting the tube is not limited to any particular metal, and the metals which may be used include a steel material such as stainless steel, a nonferrous structural material such as aluminum, copper, or titanium, a heat-resistant material such as nickel, cobalt, or molybdenum, a low melting point metal material such as lead or tin, a noble metal material such as gold, silver or platinum, and an alloy thereof.

The tube is not limited for its length. When the tube is used for an injection needle, however, the length of the tube which inevitably has a thin wall thickness must be appropriately selected in accordance with the strength required for the tube. For example, when the tube is used for an injection needle, the tube having a diameter corresponding to the injection needle of gage 25 to 33 should have a Vickers hardness of at least 200.

Next, the method for producing a metal tube according to the present invention is described. FIGS. 3A, 3B, 4C and 4D illustrate a typical process of producing the metal tube according to the method of the present invention. To be more specific, FIGS. 3A, 3B, 4C and 4D show the process of producing the tapered tube having a circular cross section shown in FIG. 1A which has a distal end of a smaller diameter and a proximal end of a larger diameter. It is to be noted, however, that the procedure shown by the drawings are presented for ease of understanding on the method of the present invention, and the method of the present invention is by no means limited by such illustration.

Figure 3A:
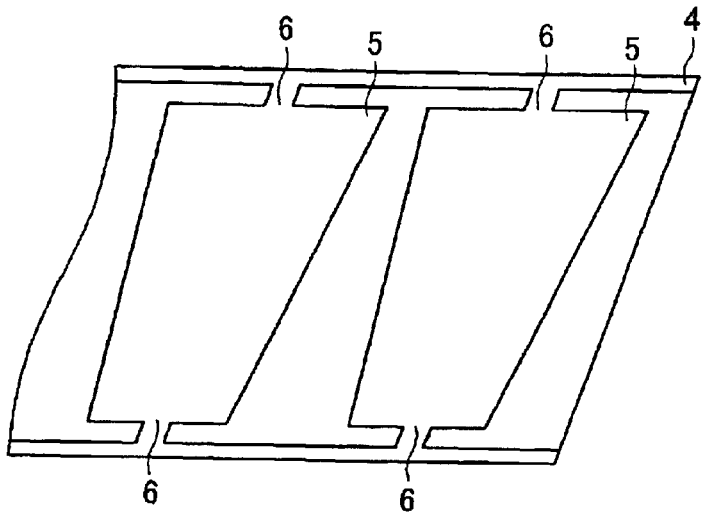
FIGS. 3A and 3B schematically show the tube production according to the method of the invention, FIG. 3A being a view when a plate member having a development shape of a tube has been blanked from a metal thin plate.

In the method of the present invention, a plate member 5 having a development shape of a tube is blanked from a metal thin plate 4 having a thickness of up to 0.25 mm as shown in FIG. 3A. In this step, it is important that the plate member 5 is not completely blanked out of the metal thin plate 4, but is partly left tied to the thin plate 4. The shape of the plate member 5 blanked may be appropriately selected depending on the final shape of the tube having at least two inner diameters. In the case of FIGS. 3A to 4D, the tube produced is a tapered tube, and the plate member 5 has a trapezoid shape having two opposing shorter sides one of which is shorter than the other, and in FIG. 3A, central parts 6 in the shorter sides of the trapezoid are left uncut to form the tie strips 6 which tie the plate member 5 to the metal thin plate 4.

It is to be noted that the method used in the blanking of the plate member 5 from the metal thin plate 4 is not limited to mechanical blanking, and the plate member 5 may be thermally blanked from the metal thin plate 4 by using laser or the like.

Figure 3B:
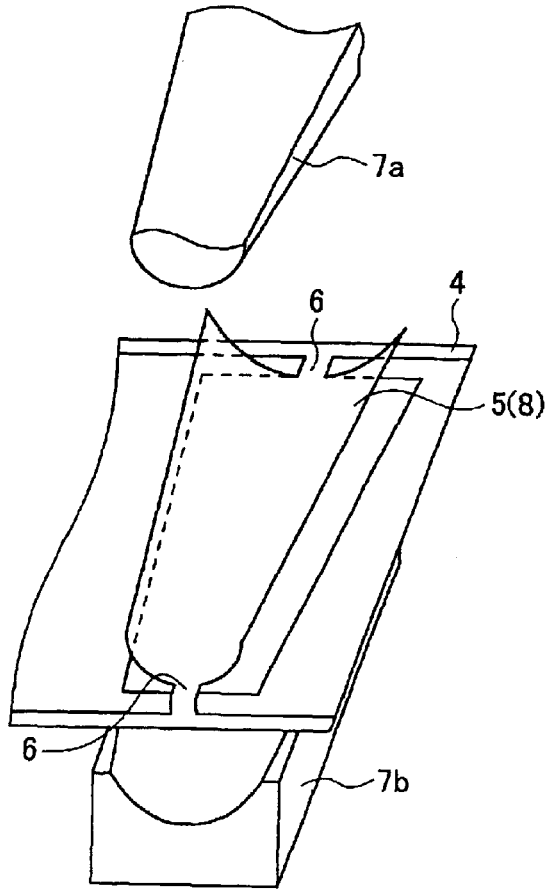

Next, the plate member 5 is press formed as shown in FIG. 3B from both of the upper and lower sides using upper and lower mold halves 7*a* and 7*b*. In the case of FIG. 3B, the plate member 5 is press formed into a curved shape about the axis extending through the opposite tie strips 6 by the convex upper mold half 7*a* and the concave lower mold half 7*b*.

In the press forming, the part of the plate member 5 corresponding to the distal or proximal end of the resulting tube 8 is preferably moved upward or downward in relation to the plane of the metal thin plate 4 so that the central axis of the tube 8 will extend parallel to the plane of the metal thin plate 4 in the course of the press forming.

Although the tube 8 obtained by the press forming has at least two inner diameters, the central axis of the tube 8 is maintained parallel to the plane of the metal thin plate 4 by the upward or downward movement of the part of the plate member 5 corresponding to the distal or proximal end of the resulting tube 8 in relation to the metal thin plate 4 since the parts in the plate member 5 corresponding to the distal and proximal ends of the tube 8 are tied to the metal thin plate 4.

More preferably, the central axis of the tube 8 in the course of the press forming after the upward or downward movement of the part of the plate member 5 corresponding to the distal or proximal end of the resulting tube 8 in relation to the metal thin plate 4 is located at a position remote from the plane of the metal thin plate 4.

In FIG. 3B, as a result of the uplifting of the distal end (the end with the smaller inner diameter) of the tube 8 from the plane of the metal thin plate 4 while maintaining the proximal end (the end with the larger inner diameter) of the tube 8 in the same plane as the plane of the metal thin plate 4, the central axis of the tube 8 in the course of the press forming extends parallel to the plane of the metal thin plate 4, and simultaneously, at a distance from the plane of the metal thin plate 4, and to be more specific at a position above the plane of the metal thin plate 4.

Figure 5:
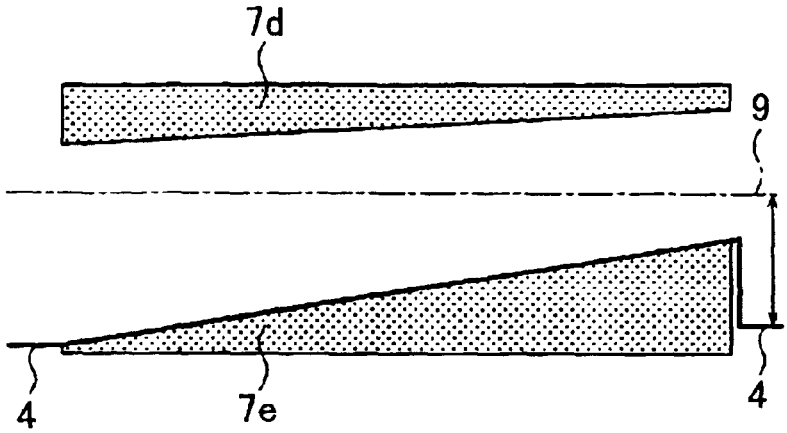
FIG. 5 is a lateral cross sectional view of a mold used in producing the metal tube of FIG. 1A.
Figure 6A:
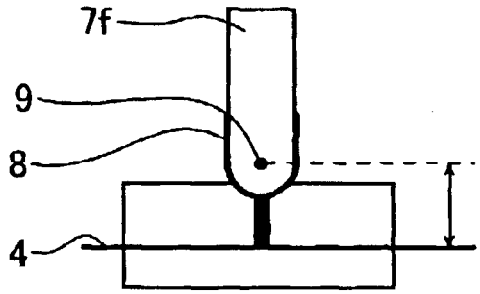
FIGS. 6A and 6B are views showing the stage corresponding to FIG. 4C in the production of the tube of FIG. 1A using the mold of FIG. 5, FIG. 6A being a cross section taken from the side of the tube having a smaller inner diameter.
Figure 6B:
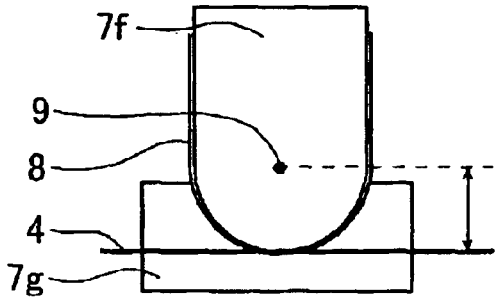

In order to uplift from the plane of the metal thin plate 4 the distal end of the tube 8 into which the plate member 5 is being press formed, the plate member 5 which is tied to the metal thin plate 4 through the tie strips 6 may be press formed by using a mold of adequate configuration. For example, when the tube 8 formed is a tapered hollow tube with a circular cross section having the distal end of a smaller diameter and the proximal end of a larger diameter as shown in FIG. 1A, the press forming may be accomplished by using upper and lower mold halves 7*d* and 7*e* which form a cross sectional shape corresponding to the profile of the tube 8 as shown in FIG. 5. As will be understood from FIG. 5, when the mold halves 7*d* and 7*e* are used, the central axis 9 of the tube 8 in the course of the press forming will extend parallel to the plane of the metal thin plate 4, and will be located at a position remote from the plane of metal thin plate 4. FIGS. 6A and 6B are views showing the production stage corresponding to FIG. 4C when the tube 8 shown in FIG. 1A is produced by using the upper and lower mold halves 7*d* and 7*e* shown in FIG. 5. FIG. 6A is a cross section seen from the side of the tube 8 having the smaller inner diameter, and FIG. 6B is a cross section seen from the side of the tube 8 having the larger inner diameter. As will be understood from FIGS. 6A and 6B, the central axis 9 of the tube 8 extends at a position above and remote from the plane of the metal thin plate 4.

The method for placing the central axis 9 of the tube 8 in the course of the press forming at a position parallel to the plane of the metal thin plate 4 and also, at a position remote from the metal thin plate 4 has been described in the case in which the part of the plate member 5 corresponding to the distal end (the end with the smaller inner diameter) of the tube 8 is uplifted from the metal thin plate 4 to thereby place the central axis 9 of the resulting tube 8 parallel to and above the plane of the metal thin plate 4 by referring to FIGS. 3A to 4D. The method of the present invention, however, is not limited to such method, and the part of the plate member 5 corresponding to the distal or proximal end of the resulting tube 8 may be moved either upward or downward in relation to the metal thin plate 4 while the plate member 5 is partially tied to the metal thin plate 4 by the tie strips 6. To be more specific, the part of the plate member 5 corresponding to the proximal end (the end with the larger inner diameter) of the resulting tube 8 may be moved downward from the metal thin plate 4 while maintaining the part of the plate member 5 corresponding to the distal end (the end with the smaller inner diameter) of the resulting tube 8 in the same plane as the plane of the metal thin plate 4 to thereby place the central axis 9 of the tube 8 parallel to and below the plane of the metal thin plate 4 contrary to the case depicted in FIGS. 3A to 4D.

It is to be noted that, while the central axis 9 of the tube 8 in the course of press forming is preferably kept at a position remote from the metal thin plate 4, also included within the scope of the invention is the method wherein the tube formation by the press forming is accomplished with the central axis 9 of the tube 8 maintained in the same plane as the plane of the metal thin plate 4. In such a case, a mold of an adequate configuration may be used so that the distal end (the end with the smaller inner diameter) and the proximal end (the end with the larger inner diameter) of the tube 8 have different amounts of displacement. For example, the plate member 5 may be press formed into the tube 8 having at least two inner diameters by adequately regulating the amount of displacement of the lower mold under the plate member so that the central axis 9 of the tube 8 will be in the same plane as the plane of the metal thin plate 4, and at the same time, parallel to the plane of the metal thin plate 4.

In the preferred embodiment of the method of the present invention, the central axis 9 of the tube 8 extends at a position remote from the plane of the metal thin plate 4, and therefore, the tie strips 6 tying the plate member 5 to the metal thin plate 4 should be longer than the length corresponding to the distance between the central axis 9 of the tube 8 and the plane of the metal thin plate 4. While the length of the tie strips 6 may be appropriately selected according to the tube size (outer diameter and length), it is preferable that the length X (mm) of the tie strips and the outer diameter R (mm) of the tube 8 meet the following relation:

$$X \geq R/2$$

wherein R is the outer diameter of the tube 8 at the distal or proximal end whose displacement from the plane of the metal thin plate 4 is larger than the other.

The above defined relation is preferable since the tube production is facilitated when the length of the tie strips 6 and the outer diameter of the tube 8 fulfill the relation as defined above.

Figure 4C:
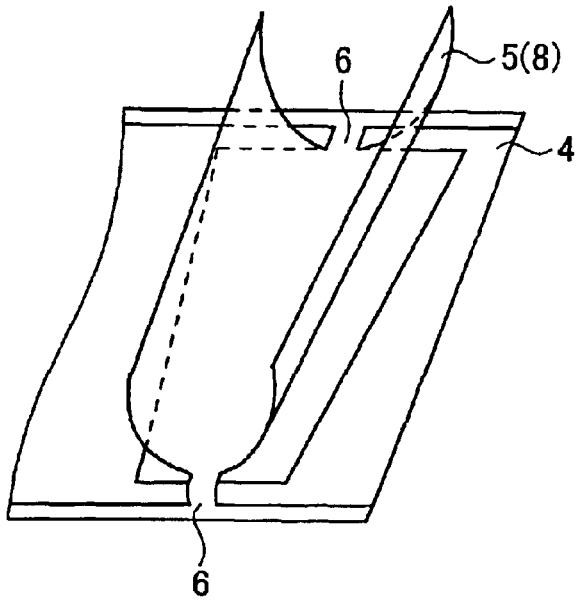
FIGS. 4C and 4D schematically show the tube production according to the method of the invention, FIG. 4C showing the plate member which has been press formed into U shape.
Figure 4C:
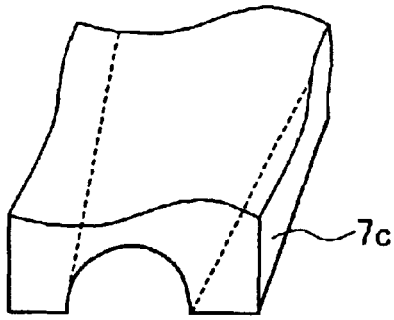
Figure 4D:
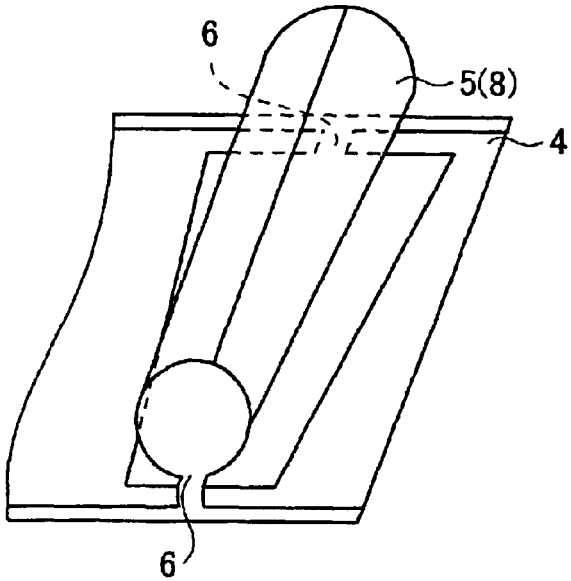
Figure 7:
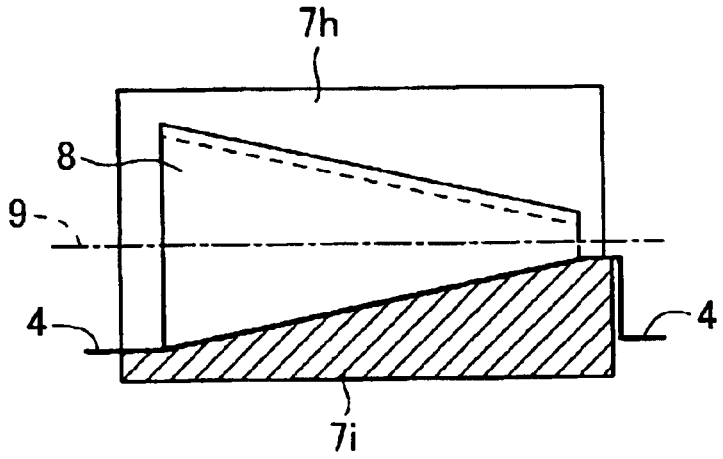
FIG. 7 is a lateral cross sectional view showing the geometrical relation between the plate member which had been formed into the tube by the step shown in FIG. 4D, the mold, and the metal thin plate.
Figure 8:
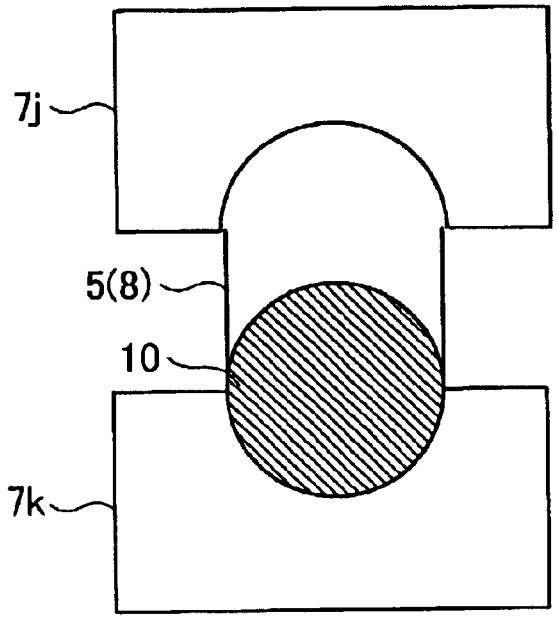
FIG. 8 is a view illustrating another embodiment of the present method wherein a core is used in addition to the mold for producing the tube.

FIG. 4C shows the plate member 5 which has been press formed to some degree. In FIG. 4C, the plate member 5 has been curled into U-shape. Such curling to the U-shape may be accomplished either by the press forming using the upper and lower mold halves 7*a* and 7*b* shown in FIG. 3B, or by the press forming using a mold having a different shape. The plate member 5 which has been curled into the U-shape is further press formed into a tube as shown in FIG. 4D by using a concave upper mold 7*c*. FIG. 7 is a lateral cross section which shows location of the tube 8 that had been formed by the step of FIG. 4D in relation to upper and lower mold halves 7*h* and 7*i* and the metal thin plate 4. As will be understood from FIG. 7, the central axis 9 of the tube 8 sandwiched between the upper and lower mold halves 7*h* and 7*i* extends parallel to and above the plane of the metal thin plate 4. In addition, as will be easily understood by those skilled in the art, the procedure of press forming into the tube as shown in FIG. 4D may be accomplished by using several steps of press forming using molds of different configurations. Furthermore, as shown in FIG. 8, the curling of the U-shaped plate member 5 shown in FIG. 4C into the tube may be accomplished by using a core 10 in addition to the upper and lower mold halves 7*j* and 7*k*.

Figure 9:
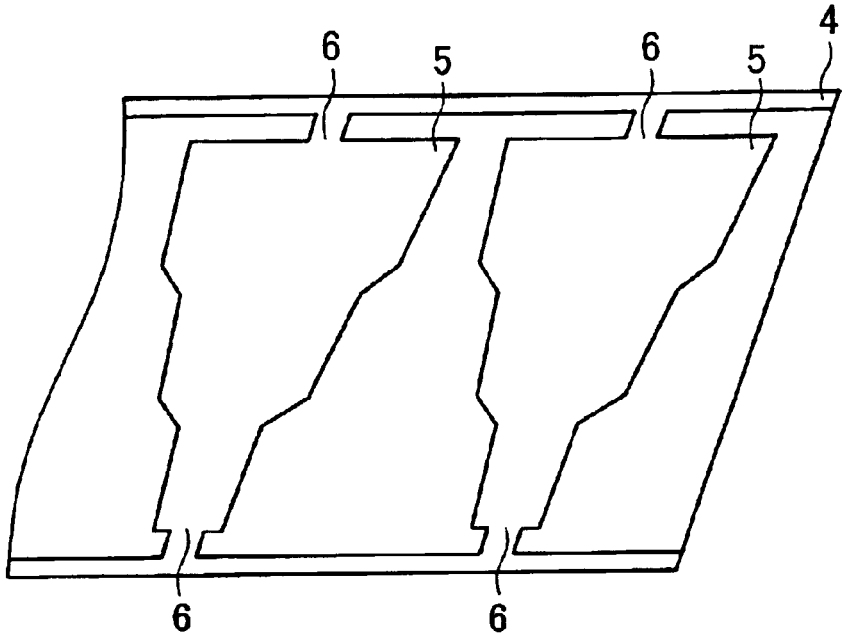
FIG. 9 is a view showing the stage corresponding to FIG. 3A in the production of the tube of FIG. 1B by the present method.
Figure 10:
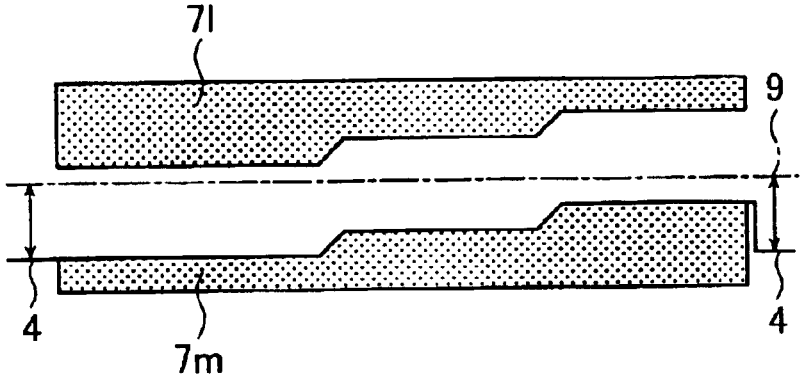
FIG. 10 is a lateral cross sectional view showing a mold used in the production of the metal tube of FIG. 1B.

The method of the present invention is capable of producing not only the tapered tube as described above but also a hollow tube of circular cross section as shown in FIG. 1B having a stepped side profile which comprises the distal portion having a small inner diameter, the proximal portion having a large inner diameter, and the intermediate portion between the distal and proximal portions which is different in the inner diameter from the distal and proximal portions. In producing the tube having the shape as shown in FIG. 1B, the plate member 5 having the development shape of the tube 8 is blanked from the metal thin plate 4 as shown in FIG. 9 with the central portions 6 in the shorter sides of the plate member 5 being left uncut to form the tie strips 6 which tie the plate member 5 to the metal thin plate 4, and the plate member 5 may be press formed by using upper and lower mold halves 7*l* and 7*m* which form a stepped cross section corresponding to the side profile of the tube 8 as shown in FIG. 10.

The seam of the tube formed by the press forming should be fluid tightly joined in some applications, for example, when the tube is used by passing a fluid therethrough as in the case of injection needle. The seam may be joined by using an adhesive. It is, however, preferable to weld the tube along its seam since the tube is made of a metal and is as thin as 1 mm or less in its outer diameter. The welding of the seam is preferably accomplished by melting the matrix of the tube, for example, by laser welding such as carbon dioxide laser welding, YAG laser welding, eximer laser welding, or the like among which the carbon dioxide laser welding and the YAG laser welding being preferred in view of their wide availability, low cost, and adaptability to micromachining.

The tube of the present invention can be obtained by cutting the tie strips 6 between the thin plate 4 and the plate member 5 after the welding of the seam. When used in an application which does not particularly require fluid-tight joining, the tube is not welded. In this case, the tube can be obtained by cutting the tie strips 6 between the thin plate 4 and the plate member 5 after formation of the tube 8 by the press forming of the plate member 5.

The thus produced tube 8 may be further processed depending on the intended use of the tube 8. For example, when the tube 8 is to be used as an injection needle, the tube 8 should be further processed, for example, to thereby provide the tube with an edge by a suitable conventional method.

EXAMPLES

Next, the present invention is described in further detail by referring to the following Examples.

Example 1

A hollow tube as shown in FIG. 1A having a circular cross section which is tapered from the distal end having a smaller inner diameter to the proximal end having a larger inner diameter was produced from a thin plate of stainless steel (SUS304) having a thickness of 0.05 mm by the procedure shown in FIGS. 3A to 4D using the upper and lower mold halves 7*d* and 7*e* shown in FIG. 5. The resulting hollow tube had the size as summarized below:

Maximum Diameter Section outer diameter: 1 mm, inner diameter: 0.9 mm

Minimum Diameter Section outer diameter: 0.7 mm, inner diameter: 0.6 mm

Length: 20 mm $R_{max}$: 0.8 $\mu$m

Example 2

A hollow tube as shown in FIG. 1B having a stepped side profile was produced from a thin plate of stainless steel (SUS304) having a thickness of 0.1 mm by blanking a plate member having the shape as shown in FIG. 9, and press forming the plate member by using the upper and lower mold halves 7*l* and 7*m* shown in FIG. 10. The hollow tube was circular in cross section, and it had a distal portion having a small inner diameter, a proximal portion having a large inner diameter, and an intermediate portion between the distal and proximal portions which was different in the inner diameter from the distal and proximal portions. The resulting hollow tube had the size as summarized below:

Maximum Diameter Section outer diameter: 1.5 mm, inner diameter: 1.3 mm

Intermediate Diameter Section outer diameter: 1 mm, inner diameter: 0.8 mm

Minimum Diameter Section outer diameter: 0.8 mm, inner diameter: 0.6 mm

Length: 20 mm $R_{max}$: 1.1 $\mu$m

Example 3

Figure 11:
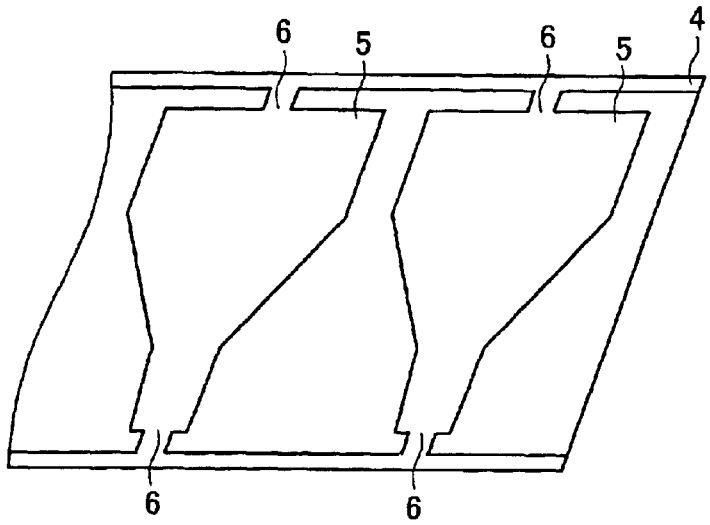
FIG. 11 is a view showing the stage corresponding to FIG. 3A in the production of the tube of FIG. 1C by the present method.
Figure 12:
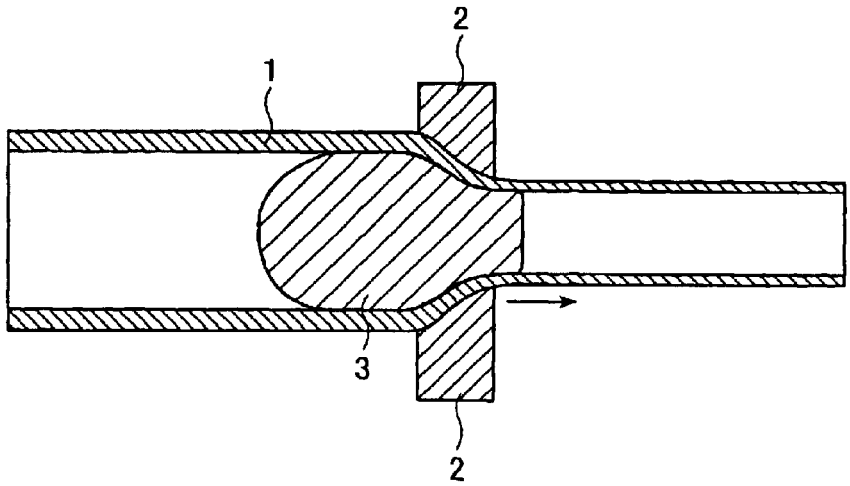
FIG. 12 PRIOR ART
FIG. 12 is a view showing the step of drawing in the conventional tube production process.

A hollow tube as shown in FIG. 1C was produced from a thin plate of stainless steel (SUS304) having a thickness of 0.05 mm by blanking a plate member having the shape as shown in FIG. 11, and press forming the plate member by using a mold having a shape corresponding to the side profile of the tube. The hollow tube was circular in cross section, and it had a distal portion having a small inner diameter, a proximal portion having a large inner diameter, and a transient portion between the distal and proximal portions. The resulting hollow tube had the size as summarized below:

Maximum Diameter Section outer diameter: 0.35 mm, inner diameter: 0.25 mm

Minimum Diameter Section outer diameter: 0.2 mm, inner diameter: 0.1 mm

Length: 20 mm $R_{max}$: 1.7 $\mu$m

The tube of the present invention has a smooth inner surface despite the presence of at least two inner diameters, and this tube is well adapted for use in such application as injection needle used for epidural injection.

The method of the present invention is capable of producing a small diameter metal tube which has at least two inner diameters and which has a tapered, stepped, or other side profile.

What is claimed:

1. A metal tube produced by press forming, which has at least two inner diameters, wherein the inner surface of the tube has a maximum height difference (RF) in the surface roughness of up to 3 $\mu$m after press forming, and the tube has a minimum inner diameter of up to 2 mm and a maximum inner diameter of up to 5 mm.

2. The metal tube according to claim 1, wherein the metal tube is produced by the steps of:

blanking a plate member having a development shape of the metal tube from a metal thin plate such that said plate member is left partly tied to said metal thin plate;

press forming said plate member into a tubular body having said at least two inner diameters; and cutting apart said plate member partly tied to said metal thin plate to produce the metal tube having said at least two inner diameters.

3. The metal tube according to claim 2, wherein, in the step of press forming, a part of said plate member corresponding to the distal or proximal end of the tube obtained by the press forming is moved either upward or downward from the plane of said metal thin plate so that the central axis of the tube during the press forming will be parallel to the plane of said metal thin plate.

4. The metal tube according to claim 2, wherein said plate member, after having been press formed into a tubular body having said at least two inner diameters, is welded at a seam thereon to produce the metal tube having said at least two inner diameters.

5. The metal tube according to claim 3, wherein said plate member, after having been press formed into a tubular body having said at least two inner diameters, is welded at a seam thereon to produce the metal tube having said at least two inner diameters.

* * * * *